US009911423B2

(12) United States Patent
Vasilache et al.

(10) Patent No.: US 9,911,423 B2
(45) Date of Patent: Mar. 6, 2018

(54) MULTI-CHANNEL AUDIO SIGNAL CLASSIFIER

(71) Applicant: Nokia Technologies Oy, Espoo (FI)

(72) Inventors: Adriana Vasilache, Tampere (FI); Lasse Juhani Laaksonen, Tampere (FI); Anssi Sakari Rämö, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/110,356

(22) PCT Filed: Jan. 13, 2014

(86) PCT No.: PCT/FI2014/050019
§ 371 (c)(1),
(2) Date: Jul. 7, 2016

(87) PCT Pub. No.: WO2015/104447
PCT Pub. Date: Jul. 16, 2015

(65) Prior Publication Data

US 2016/0329056 A1 Nov. 10, 2016

(51) Int. Cl.

| | |
|---|---|
| ***G10L 19/008*** | (2013.01) |
| ***G10L 19/02*** | (2013.01) |
| ***G10L 19/035*** | (2013.01) |
| ***G10L 25/18*** | (2013.01) |
| *G10L 25/03* | (2013.01) |
| *G10L 19/22* | (2013.01) |

(Continued)

(52) U.S. Cl.
CPC ..... *G10L 19/008* (2013.01); *G10L 19/0204* (2013.01); *G10L 19/035* (2013.01); *G10L 25/18* (2013.01); *G10L 19/22* (2013.01); *G10L 25/03* (2013.01); *H04R 2499/11* (2013.01); *H04S 1/007* (2013.01); *H04S 3/008* (2013.01); *H04S 2420/01* (2013.01); *H04S 2420/07* (2013.01)

(58) Field of Classification Search
USPC ..... 704/500–504
See application file for complete search history.

(56) References Cited

U.S. PATENT DOCUMENTS 6,298,071 B1 10/2001 Taylor et al.
7,181,019 B2 * 2/2007 Breebaart ..... G10L 19/008 381/17

(Continued)

FOREIGN PATENT DOCUMENTS

CN 1961511 5/2007
CN 101048964 A 10/2007

(Continued)

OTHER PUBLICATIONS

International Search Report and Written Opinion received for corresponding Patent Cooperation Treaty Application No. PCT/FI2014/050019, dated Oct. 8, 2014, 11 pages.

(Continued)

*Primary Examiner* — Abul Azad
(74) *Attorney, Agent, or Firm* — Alston & Bird LLP

(57) ABSTRACT

It is disclosed inter alia a method comprising: estimating a value of entropy for a multi-channel audio signal; determining a channel configuration of the multi-channel audio signal from the value of entropy; and encoding the multi-channel audio signal, wherein the mode of encoding is dependent on the channel configuration.

17 Claims, 6 Drawing Sheets

(51) Int. Cl.
*H04S 1/00* (2006.01)
*H04S 3/00* (2006.01)

(56) References Cited

U.S. PATENT DOCUMENTS

| | | | | |
|---|---|---|---|---|
| 7,283,957 | B2 | 10/2007 | Minde et al. | |
| 8,374,365 | B2 * | 2/2013 | Goodwin | G10L 19/173 381/17 |
| 2003/0026490 | A1 | 2/2003 | Thyagarajan | |
| 2005/0157883 | A1 | 7/2005 | Herre et al. | |
| 2005/0195981 | A1 | 9/2005 | Faller et al. | |
| 2005/0226426 | A1 | 10/2005 | Oomen et al. | |
| 2006/0088093 | A1 | 4/2006 | Lakaniemi et al. | |
| 2006/0235679 | A1 | 10/2006 | Sperschneider et al. | |
| 2007/0016416 | A1 | 1/2007 | Roden et al. | |
| 2007/0105631 | A1 * | 5/2007 | Herr | G07F 17/32 463/42 |
| 2007/0271095 | A1 | 11/2007 | Miyasaka et al. | |
| 2008/0033732 | A1 * | 2/2008 | Seefeldt | G10L 19/008 704/500 |
| 2008/0192941 | A1 * | 8/2008 | Oh | G10L 19/008 381/17 |
| 2008/0199014 | A1 | 8/2008 | Kurniawati et al. | |
| 2008/0201153 | A1 * | 8/2008 | Breebaart | H04S 3/008 704/500 |
| 2008/0224901 | A1 | 9/2008 | Pang et al. | |
| 2009/0164223 | A1 | 6/2009 | Fejzo | |
| 2009/0171658 | A1 | 7/2009 | Margalit et al. | |
| 2010/0169080 | A1 * | 7/2010 | Tsuchinaga | G10L 19/032 704/200.1 |
| 2010/0232619 | A1 | 9/2010 | Uhle et al. | |
| 2010/0324708 | A1 | 12/2010 | Ojanpera | |
| 2011/0166866 | A1 | 7/2011 | Breebaart | |
| 2011/0173005 | A1 | 7/2011 | Hilpert et al. | |
| 2011/0211703 | A1 | 9/2011 | Villemoes et al. | |
| 2012/0035940 | A1 | 2/2012 | Jeong et al. | |
| 2012/0207311 | A1 | 8/2012 | Hoang et al. | |
| 2012/0265523 | A1 | 10/2012 | Greer et al. | |
| 2012/0269353 | A1 | 10/2012 | Herre et al. | |
| 2013/0230176 | A1 | 9/2013 | Virette et al. | |
| 2013/0262129 | A1 * | 10/2013 | Choi | G10K 11/002 704/500 |
| 2014/0023196 | A1 | 1/2014 | Xiang et al. | |
| 2014/0303984 | A1 | 10/2014 | Johnson et al. | |
| 2015/0025894 | A1 | 1/2015 | Lee et al. | |
| 2015/0025895 | A1 * | 1/2015 | Schildbach | G10L 19/16 704/500 |

FOREIGN PATENT DOCUMENTS

| | | | |
|---|---|---|---|
| CN | 101223578 | A | 7/2008 |
| DE | 4345171 | A1 | 3/1995 |
| EP | 1376538 | A1 | 1/2004 |
| EP | 1746751 | A1 | 1/2007 |
| EP | 2304723 | A1 | 3/2009 |
| EP | 2144229 | A1 | 1/2010 |
| EP | 2144230 | A1 | 1/2010 |
| KR | 2007-0051915 | | 5/2007 |
| RU | 2010 112890 | A | 11/2011 |
| RU | 2011 100135 | A | 7/2012 |
| WO | 2004/080125 | A1 | 9/2004 |
| WO | 2004/098105 | A1 | 11/2004 |
| WO | 2005/101370 | A1 | 10/2005 |
| WO | 2006/048226 | A1 | 5/2006 |
| WO | 2006/072270 | A1 | 7/2006 |
| WO | 2007/009548 | A1 | 1/2007 |
| WO | 2008/069593 | A1 | 6/2008 |
| WO | 2009/048239 | A2 | 4/2009 |
| WO | 2009/150290 | A1 | 12/2009 |
| WO | WO 2010/006717 | A1 | 1/2010 |
| WO | 2010/091736 | A1 | 8/2010 |
| WO | 2011/029984 | A1 | 3/2011 |
| WO | 2012/025282 | A1 | 3/2012 |
| WO | 2012/101483 | A1 | 8/2012 |
| WO | 2013156814 | | 10/2013 |
| WO | 2013179084 | | 12/2013 |
| WO | 2014/013294 | A1 | 1/2014 |
| WO | WO-2014/108738 | | 7/2014 |
| WO | WO-2014/147441 | | 9/2014 |

OTHER PUBLICATIONS

International Search Report and Written Opinion received for corresponding Patent Cooperation Treaty Application No. PCT/IB2013/050154, dated Oct. 24, 2013, 13 pages.

"7 KHz Audio-Coding Within 64 kbit/s: New Annex D With Stereo Embedded Extension", ITU-T Recommendation G.722 Amendment D, vol. 10, May 8, 2012, pp. 1-52.

Montalvao et al., "Simple Entropy Estimator for Small Datasets", Electronics Letters, vol. 48, No. 17, Aug. 16, 2012, 2 Pages.

International Search Report and Written Opinion received for corresponding Patent Cooperation Treaty Application No. PCT/IB2013/052203, dated Feb. 25, 2014, 11 pages.

International Search Report and Written Opinion received for corresponding Patent Cooperation Treaty Application No. PCT/IB2013/053324, dated Mar. 26, 2014, 20 pages.

International Search Report and Written Opinion received for corresponding Patent Cooperation Treaty Application No. PCT/IB2013/054407, dated Apr. 14, 2014, 17 pages.

Briand et al., "Parametric Coding of Stereo Audio Based on Principal Component Analysis", Proc. of the 9th Int. Conference on Digital Audio Effects, Sep. 18-20, 2006, pp. 291-296.

Extended European Search Report received for corresponding European Patent Application No. 13196575.8, dated Aug. 4, 2014, 9 pages.

Non-Final Office action received for corresponding U.S. Appl. No. 14/141,377, dated Jul. 31, 2015, 8 pages.

Office action received for corresponding Chinese Patent Application No. 201410008366.3, dated May 5, 2016, 8 pages of office action and no page of translation available.

Non-Final Office action received for corresponding U.S. Appl. No. 14/785,518, dated Sep. 13, 2016, 14 pages.

Extended European Search Report received for corresponding European Patent Application No. 13878647.0, dated Oct. 11, 2016, 8 pages.

Office action received for corresponding Korean Patent Application No. 2015-7036550, dated Nov. 10, 2016, 6 pages of office action and no pages of office action translation available.

Herre et al., "MPEG Surround—The ISO/MPEG Standard for Efficient and Compatible Multichannel Audio Coding", Journal of the Audio Engineering Society, vol. 56, No. 11, Nov. 2008, pp. 932-955.

Extended European Search Report received for corresponding European Patent Application No. 13883180.5, dated Nov. 22, 2016, 7 pages.

"Information Technology—MPEG Audio Technologies—Part 1: MPEG Surround", ISO/IEC JTC 1/SC 29, ISO/IEC 23003-1:2006, Jul. 21, 2006, 289 pages.

Roden et al., "A Study of the MPEG Surround Quality Versus Bit-Rate Curve", Audio Engineering Society, Oct. 5-8, 2007, pp. 1-15.

"New Annex F With Stereo Embedded Extension for ITU-T G.711.1", International Telecommunication Union, vol. 10, May 9, 2012, pp. 1-52.

Non-Final Office action received for corresponding U.S. Appl. No. 14/893,604, dated Nov. 28, 2016, 15 pages.

Non-Final Office action received for corresponding U.S. Appl. No. 14/777,222, dated Dec. 6, 2016, 16 pages.

Extended European Search Report received for corresponding European Patent Application No. 13885624.0, dated Jan. 5, 2017, 6 pages.

"7 KHz Audio-Coding Within 64 kbit/s: New Annex X With Stereo Embedded Extension", ITU-T Recommendation G.722 Amendment X, vol. 10, No. 16, May 8, 2012, pp. 1-52.

Final Office action received for corresponding U.S. Appl. No. 14/777,222, dated May 12, 2017, 12 pages.

(56) References Cited

OTHER PUBLICATIONS

Extended European Search Report received for corresponding European Patent Application No. 14877980.4, dated May 18, 2017, 4 pages.
Bosi M. et al., ISO/IEC MPEG-2 *Advanced Audio Coding*, Journal of the Audio Engineering Society, vol. 45, No. 11, Oct. 1997, 789-814.
Office action received for corresponding Korean Patent Application No. 2016-7022075, dated Jul. 11, 2017, 8 pages.
Office Action for Russian Application No. 2016131192/08(048453) dated Oct. 26, 2017, 14 pages total.
Advisory Action for U.S. Appl. No. 14/777,222 dated Sep. 14, 2017.
Office Action for U.S. Appl. No. 14/777,222 dated Nov. 9, 2017.

* cited by examiner

MULTI-CHANNEL AUDIO SIGNAL CLASSIFIER

RELATED APPLICATION

This application was originally filed as PCT Application No. PCT/FI2014/050019 filed Jan. 13, 2014.

FIELD

The present application relates to the classification of a multichannel or stereo audio signal for an audio encoder, and in particular, but not exclusively to a multichannel or stereo audio signal encoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise).

An audio codec can also be configured to operate with varying bit rates. At lower bit rates, such an audio codec may be optimized to work with speech signals at a coding rate equivalent to a pure speech codec. At higher bit rates, the audio codec may code any signal including music, background noise and speech, with higher quality and performance. A variable-rate audio codec can also implement an embedded scalable coding structure and bitstream, where additional bits (a specific amount of bits is often referred to as a layer) improve the coding upon lower rates, and where the bitstream of a higher rate may be truncated to obtain the bitstream of a lower rate coding. Such an audio codec may utilize a codec designed purely for speech signals as the core layer or lowest bit rate coding.

An audio codec is designed to maintain high (perceptual) quality while improving the compression ratio. Thus it is common for the audio codec to adopt a multimode approach for encoding the input audio signal, in which a particular mode of coding is selected according to the channel configuration of the input audio signal.

An audio codec can be configured to operate with a multiple channel input audio signal, and in particular a bi-channel input audio signal. One such bi-channel configuration may be a stereo audio signal comprising two similar audio signals each having a different phase and sound pressure level. These differences may be attributed to the stereo signal being acquired by two omnidirectional microphones separated a reasonable distance apart. Another bi-channel configuration can be a binaural signal which is distinguished from the stereo signal by being acquired by two omnidirectional microphones with a relatively short separation. Typically the distance of separation when acquiring a binaural signal is of the order of a few centimeters to be commensurate with the distance between the right and left ears of the typical human head.

SUMMARY

There is provided according to the application a method comprising estimating a value of entropy for a multi-channel audio signal; determining a channel configuration of the multi-channel audio signal from the value of entropy; and encoding the multi-channel audio signal, wherein the mode of encoding is dependent on the channel configuration.

The multi-channel audio signal comprises at least a first audio channel signal and a second audio channel signal, and wherein estimating the value of entropy for the multi-channel audio signal may comprise: transforming the first audio channel signal and the second audio channel signal each into a frequency domain audio signal comprising a plurality of frequency bands; determining a relative audio signal level by determining an audio signal level in a frequency band of the first audio channel signal relative to an audio signal level in a frequency band of the second audio channel signal; and determining the value of entropy from the relative audio signal level.

Determining the channel configuration of the multi-channel audio signal may comprise: comparing the value of entropy against a threshold value; classifying the channel configuration as a first type of channel configuration when the value of entropy is below or equal to the threshold value; and classifying the channel configuration as a second type of channel configuration when the value of entropy is above the threshold value.

Determining the value of entropy from the relative audio signal level may comprise: determining the probability of the relative audio signal level by determining a histogram of a plurality of relative audio signal levels from an audio frame of the multi-channel audio signal.

Alternatively, determining the value of entropy from the relative audio signal level may comprise: estimating the average number of relative audio signal level values between a coincidence of two relative audio signal level values with the same value by sequentially observing a sequence of relative audio signal level values from an audio frame of the multi-channel audio signal.

The multi-channel audio signal may comprise a bi-channel audio signal, and wherein the first type of channel configuration may be a binaural audio channel, and the second type of channel configuration may be a stereo audio channel.

The audio signal level may comprise the magnitude of the audio signal in the frequency band.

The relative audio signal level may be an interaural level difference.

According to a second aspect there is provided an apparatus configured to: estimate a value of entropy for a multi-channel audio signal; determine a channel configuration of the multi-channel audio signal from the value of entropy; and encode the multi-channel audio signal, wherein the mode of encoding is dependent on the channel configuration.

The multi-channel audio signal may comprise at least a first audio channel signal and a second audio channel signal, and wherein the apparatus configured to estimate the value of entropy for the multi-channel audio signal may be further configured to: transform the first audio channel signal and the second audio channel signal each into a frequency domain audio signal comprising a plurality of frequency bands; determine a relative audio signal level by the apparatus being configured to determine an audio signal level in a frequency band of the first audio channel signal relative to an audio signal level in a frequency band of the second audio channel signal; and determine the value of entropy from the relative audio signal level.

The apparatus configured to determine the channel configuration of the multi-channel audio signal may be further configured to: compare the value of entropy against a threshold value; classify the channel configuration as a first type of channel configuration when the value of entropy is below or equal to the threshold value; and classify the channel configuration as a second type of channel configuration when the value of entropy is above the threshold value.

The apparatus configured to determine the value of entropy from the relative audio signal level may be further configured to: determine the probability of the relative audio signal level by being configured to determine a histogram of a plurality of relative audio signal levels from an audio frame of the multi-channel audio signal.

Alternatively, the apparatus configured to determine the entropy from the relative audio signal level may be further configured to: estimate the average number of relative audio signal level values between a coincidence of two relative audio signal level values with the same value by sequentially observing a sequence of relative audio signal level values from an audio frame of the multi-channel audio signal.

The multi-channel audio signal may comprise a bi-channel audio signal, and wherein the first type of channel configuration may be a binaural audio channel, and the second type of channel configuration may be a stereo audio channel.

The audio signal level may comprise the magnitude of the audio signal in the frequency band.

The relative audio signal level may be an interaural level difference.

According to a third aspect there is provided an apparatus comprising at least one processor and at least one memory including computer code, the at least one memory and the computer code configured to with the at least one processor cause the apparatus to: estimate a value of entropy for a multi-channel audio signal; determine a channel configuration of the multi-channel audio signal from the value of entropy; and encode the multi-channel audio signal, wherein the mode of encoding is dependent on the channel configuration.

The multi-channel audio signal may comprise at least a first audio channel signal and a second audio channel signal, and wherein the apparatus caused to estimate the value of entropy for the multi-channel audio signal may be further caused to: transform the first audio channel signal and the second audio channel signal each into a frequency domain audio signal comprising a plurality of frequency bands; determine a relative audio signal level by the apparatus being caused to determine an audio signal level in a frequency band of the first audio channel signal relative to an audio signal level in a frequency band of the second audio channel signal; and determine the value of entropy from the relative audio signal level.

The apparatus caused to determine the channel configuration of the multi-channel audio signal may be further caused to: compare the value of entropy against a threshold value; classify the channel configuration as a first type of channel configuration when the value of entropy is below or equal to the threshold value; and classify the channel configuration as a second type of channel configuration when the value of entropy is above the threshold value.

The apparatus caused to determine the value of entropy from the relative audio signal level may be further caused to: determine the probability of the relative audio signal level by being caused to determine a histogram of a plurality of relative audio signal levels from an audio frame of the multi-channel audio signal.

Alternatively, the apparatus caused to determine the value of entropy from the relative audio signal level may be further caused to: estimate the average number of relative audio signal level values between a coincidence of two relative audio signal level values with the same value by sequentially observing a sequence of relative audio signal level values from an audio frame of the multi-channel audio signal.

The multi-channel audio signal may comprise a bi-channel audio signal, and wherein the first type of channel configuration may be a binaural audio channel, and the second type of channel configuration may be a stereo audio channel.

The audio signal level may comprise the magnitude of the audio signal in the frequency band.

The relative audio signal level may be an interaural level difference.

There is provided according to a fourth aspect a computer program code realizing the following when executed by a processor: estimating a value of entropy for a multi-channel audio signal; determining a channel configuration of the multi-channel audio signal from the value of entropy; and encoding the multi-channel audio signal, wherein the mode of encoding is dependent on the channel configuration.

An electronic device may comprise apparatus as described above.

A chipset may comprise apparatus as described above.

BRIEF DESCRIPTION OF DRAWINGS

For better understanding of the present application and as to how the same may be carried into effect, reference will now be made by way of example to the accompanying drawings in which.

DESCRIPTION OF SOME EMBODIMENTS

The following describes in more detail possible stereo and multichannel speech audio codecs, including multimode audio codecs.

Some multimode audio codecs can be configured to encode stereo audio signals differently from binaural audio signals, and without prior knowledge as to which of the two types of multichannel audio signal is presented to the codec, the codec is unable to preselect the best mode of encoding. This can lead to the problem of an audio codec having to encode the input two channel audio signal (or bi-channel audio signal) in both a stereo mode of operation and a binaural mode of operation in order to ensure that the input multichannel audio signal has been encoded with the best mode of operation.

This problem can be further exacerbated if the input audio signal is frequently switching between a stereo signal and a binaural signal resulting in the codec being required to continually code in a dual mode of operation in order to ensure that the input audio signal is encoded with the optimum mode.

The concept for embodiments as described herein may proceed from the aspect that some features of binaural and stereo signals may differ as a result of the difference in the physical separation between microphones when the respective signals are acquired. These features may be used to distinguish one signal from another. This enables a multi-mode audio coder to incorporate a pre-classification stage in which the particular input audio signal can be initially identified in order that the best mode of encoding is selected before the encoding of the input audio signal is commenced.

Figure 1:
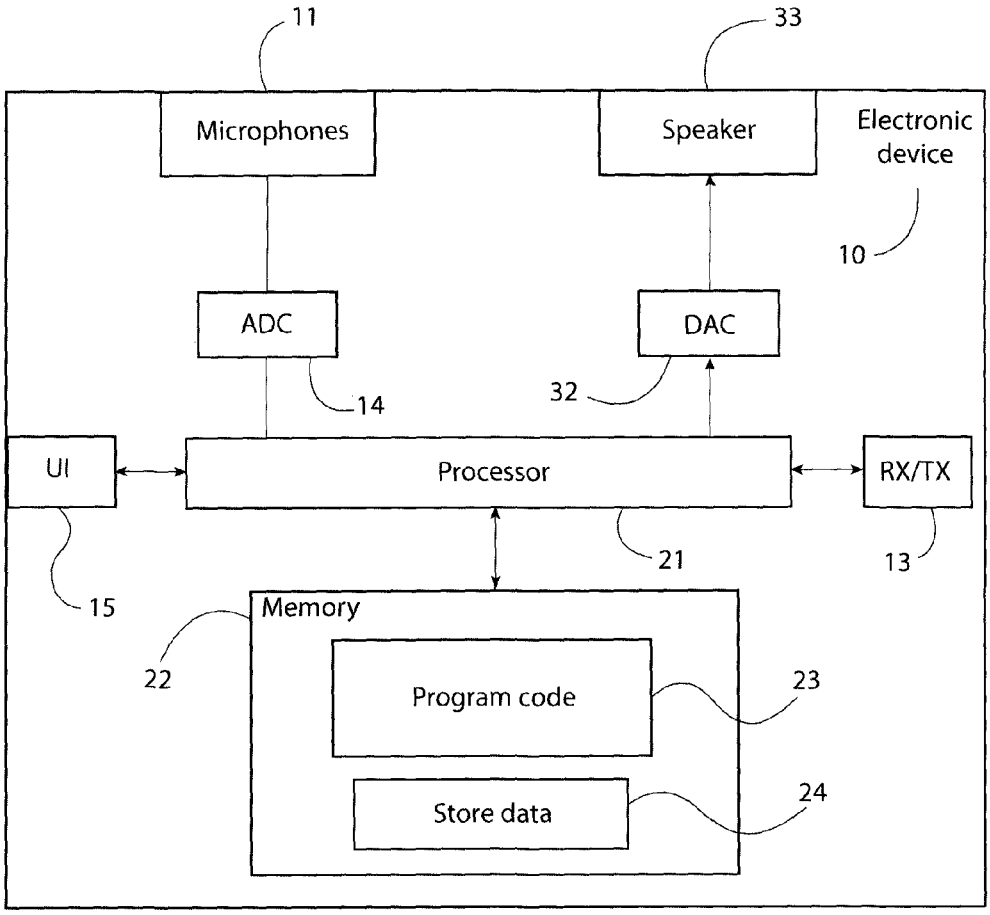
FIG. 1 shows schematically an electronic device employing some embodiments.

In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise a multichannel or stereo encoding or decoding code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented in hardware and/or firmware.

The user interface 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

The processor 21 in such embodiments then processes the digital audio signal in the same way as described with reference to the system shown in FIG. 2 and the encoder shown in FIG. 3.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

Figure 3:
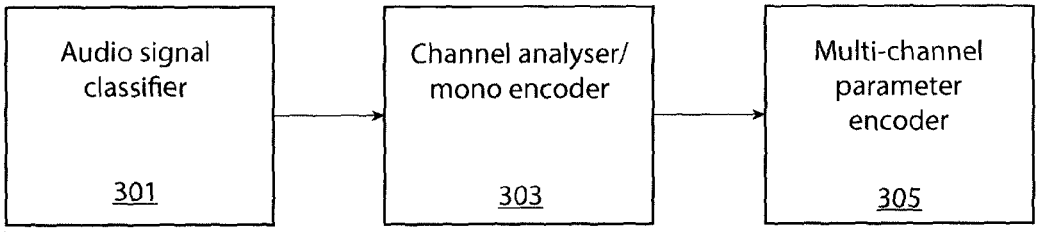
FIG. 3 shows schematically an encoder as shown in FIG. 2 according to some embodiments.
Figure 4:
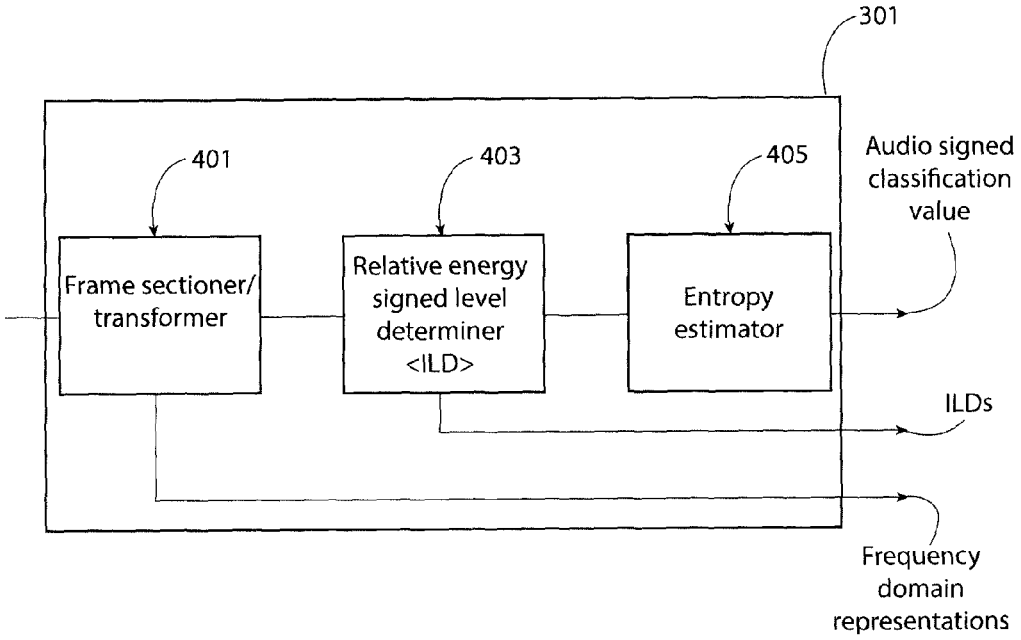
FIG. 4 shows schematically an audio signal classifier as shown in FIG. 3 in further detail according to some embodiments.
Figure 5:
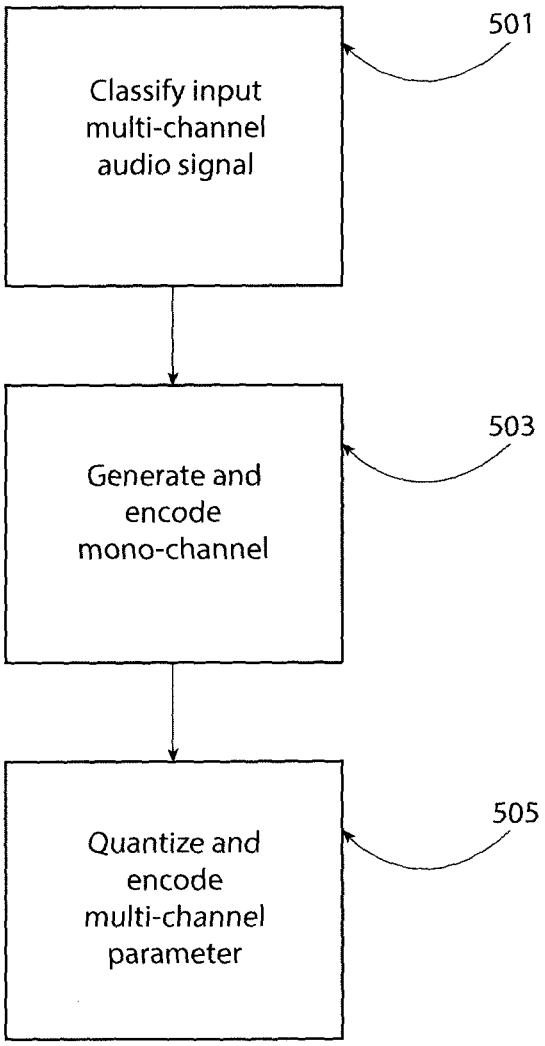
FIG. 5 shows a flow diagram illustrating the operation of the encoder shown in FIG. 3 according to some embodiments.
Figure 6:
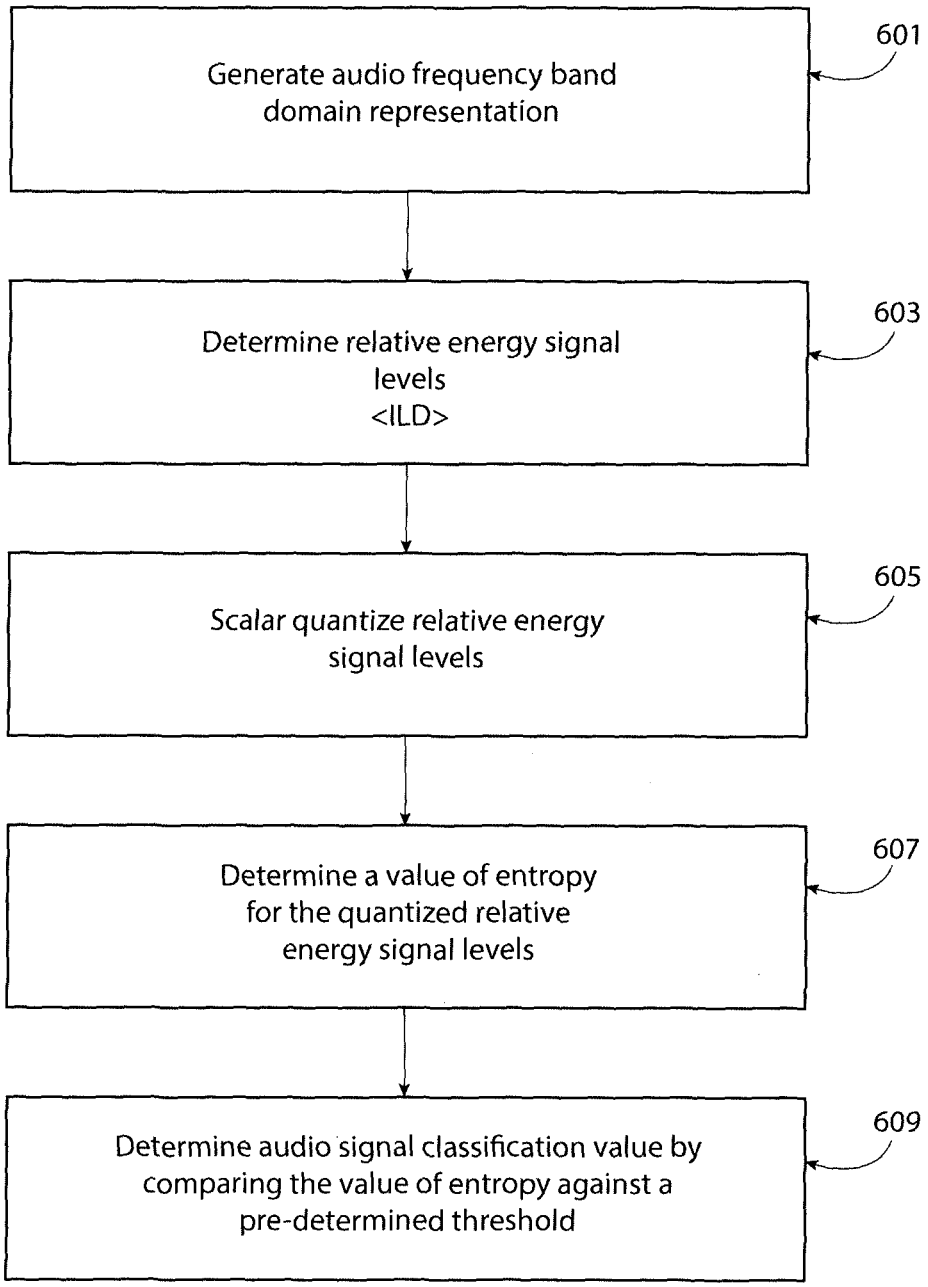
FIG. 6 shows a flow diagram illustrating the operation of the audio signal classifier as shown in FIG. 4 according to some embodiments.

It would be appreciated that the schematic structures described in FIGS. 1 to 4, and the method steps shown in FIGS. 5 and 6 represent only a part of the operation of an audio codec and specifically part of a stereo encoder apparatus or method as exemplarily shown implemented in the apparatus shown in FIG. 1.

Figure 2:
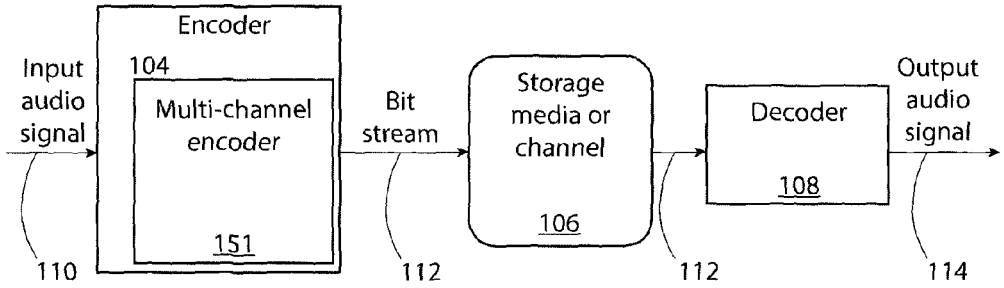
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104 and in particular a stereo encoder 151, a storage or media channel 106 and a decoder 108. It would be understood that as described above some embodiments can comprise or implement one of the encoder 104 or decoder 108 or both the encoder 104 and decoder 108.

The encoder 104 compresses an input audio signal 110 producing a bit stream 112, which in some embodiments can be stored or transmitted through a media channel 106. The encoder 104 furthermore can comprise a multichannel encoder 151 as part of the overall encoding operation. It is to be understood that the multichannel encoder may be part of the overall encoder 104 or a separate encoding module.

The bit stream 112 can be received within the decoder 108. The decoder 108 decompresses the bit stream 112 and produces an output audio signal 114. The decoder 108 can comprise a multichannel decoder as part of the overall decoding operation. It is to be understood that the multichannel decoder may be part of the overall decoder 108 or a separate decoding module. The bit rate of the bit stream 112 and the quality of the output audio signal 114 in relation to the input signal 110 are the main features which define the performance of the coding system 102.

FIG. 3 shows schematically the encoder 104 according to some embodiments.

FIG. 5 shows schematically in a flow diagram the operation of the encoder 104 according to some embodiments.

The concept for the embodiments as described herein is to classify the input multi-channel audio signal before being encoded. To that respect FIG. 3 shows an example encoder 104 according to some embodiments. Furthermore with respect to FIG. 5 the operation of the encoder 104 is shown in further detail.

The encoder 104 in some embodiments comprises an audio signal classifier 301. The audio signal classifier 301 is configured to receive a multi-channel audio signal and generate frequency domain representations of this audio signal. These frequency domain representations can be passed to the channel analyser/mono encoder 303 for further processing and coding.

The audio signal classifier 301 is configured to analyse the frequency domain representations of the audio signals in order to derive an audio signal classification value for the input multi-channel audio signal. The derived audio signal classification value indicates the channel configuration of the input multi-channel audio signal. The audio signal classification value can then be passed to the channel analyser/mono encoder 303 and the multi-channel parameter encoder 305 whereby it can be used to identify a particular mode of encoding for the channel analyser/mono encoder 303 and the multi-channel parameter encoder 305.

In a first group of embodiments the audio signal classifier 301 of the encoder 104 may be arranged to receive a multi-channel audio signal comprising at least bi-channel input audio signal with a left and right channel. In these embodiments the audio signal classifier 301 may determine an audio signal classification value which indicates whether the input audio signal comprises a bi-channel audio signal which is either stereo or binaural.

With respect to FIG. 4 an example audio signal classifier 301 according to some embodiments is described in further detail. Furthermore with respect to FIG. 6 the operation of the audio signal classifier 301 as shown in FIG. 4 is shown according to some embodiments.

In some embodiments the audio signal classifier 201 comprises a frame sectioner/transformer 401. The frame sectioner/transformer 401 can be configured to section or segment the audio signal from each of the left and right channels 110 into sections or frames suitable for frequency domain transformation. The frame sectioner/transformer 401 in some embodiments can further be configured to window these frames or sections of audio signal data from the left and right channels with any suitable windowing function. For example the frame sectioner/transformer 201 can be configured to generate frames of 20 ms which overlap preceding and succeeding frames by 10 ms each.

In some embodiments the frame sectioner/transformer 401 can be configured to perform any suitable time to frequency domain transformation on the audio signals from the left and right channels. For example the time to frequency domain transformation can be a Discrete Fourier Transform (DFT), Fast Fourier Transform (FFT) and Modified Discrete Cosine Transform (MDCT). In the following examples a FFT is used. Furthermore the output of the time to frequency domain transformer can be further processed to generate separate frequency band domain representations (sub-band representations) of each input channel audio signal data. These bands can be arranged in any suitable manner. For example these bands can be linearly spaced, or be perceptual or psychoacoustically allocated.

The operation of generating frequency band domain representation for audio frames of each audio channel is shown in FIG. 6 by step 601.

In some embodiments the frequency domain representations are passed to a relative audio energy signal level determiner 403 which can be configured to determine the relative audio signal levels or interaural level (energy) difference (ILD) between pairs of channels for each sub band. The relative audio signal level for a sub band may be determined by finding an audio signal level in a frequency band of a first audio channel signal relative to an audio signal level in a corresponding frequency band of a second audio channel signal.

It is to be understood that in the following examples a single pair of left and right channels are analysed and processed.

In some embodiments the relative audio level for each band (or interaural level difference) can be computed using the following code

```
For (j = 0; j < NUM_OF_BANDS_FOR_SIGNAL_LEVELS; j++)
  {
    mag_l = 0.0;
    mag_r = 0.0;
    for (k = BAND_START[j]; k < BAND_START[j+1]; k++)
    {
      mag_l +=
      fft_l[k]*fft_l[k] + fft_l[L_FFT-k]*fft_l[L_FFT-k];
      mag_r +=
      fft_r[k]*fft_r[k] + fft_r[L_FFT-k]*fft_r[L_FFT-k];
    }
    mag[j] =
    10.0f*log10(sqrt((mag_l+EPSILON)/(mag_r+EPSILON)));
  }
```

Where L_FFT is the length of the FFT and EPSILON is a small value above zero to prevent division by zero problems. The relative audio energy signal level determiner in such embodiments effectively generates magnitude determinations for each channel (L and R) over each sub-band and then divides one channel value by the other to generate a relative value.

The operation of determining the relative audio energy signal levels (or interaural level (energy) differences) is shown in FIG. 6 by step 603.

In some embodiments any suitable interaural level (energy) difference (ILD) estimation can be performed. For example for each frame there can be two windows for which the delay and levels are estimated. Thus for example where each frame is 10 ms there may be two windows which may overlap and are delayed from each other by 5 ms. In other words for each frame there can be determined two separate level difference values which can be passed to the encoder for encoding.

Furthermore in some embodiments for each window the differences can be estimated for each of the relevant sub bands. The division of sub-bands can in some embodiments be determined according to any suitable method.

For example the sub-band division in some embodiments which then determines the number of interaural level (energy) difference (ILD) estimation can be performed according to a selected bandwidth determination. For example the generation of audio signals can be based on whether the output signal is considered to be wideband (WB), superwideband (SWB), or fullband (FB) (where the bandwidth requirement increases in order from wideband to fullband).

For the possible bandwidth selections there can in some embodiments be a particular division in subbands. Thus for example the sub-band division for the FFT domain for interaural level (energy) difference estimates can be:

ITD Sub-Bands for Wideband (WB)

const short scale1024_WB[ ]={1, 5, 8, 12, 20, 34, 48, 56, 120, 512};

ITD Sub-Bands for Superwideband (SWB)

const short scale1024_SWB[ ]={1, 2, 4, 6, 10, 14, 17, 24, 28, 60, 256, 512};

ITD Sub-Bands for Fullband (FB)

const short scale1024_FB[ ]={1, 2, 3, 4, 7, 11, 16, 19, 40, 171, 341, 448/*~21 kHz*/};

ILD sub-bands for Wideband (WB)

const short scf_band_WB[ ]={1, 8, 20, 32, 44, 60, 90, 110, 170, 216, 290, 394, 512};

ILD Sub-Bands for Superwideband (SWB)

const short scf_band_SWB[ ]={1, 4, 10, 16, 22, 30, 45, 65, 85, 108, 145, 197, 256, 322, 412, 512};

ILD Sub-Bands for Fullband (FB)

const short scf_band_FB[ ]={1, 3, 7, 11, 15, 20, 30, 43, 57, 72, 97, 131, 171, 215, 275, 341, 391, 448/*~21 kHz*/};

In other words in some embodiments there can be different sub-bands for level differences.

The relative audio energy signal level determiner 403 can be configured to output the relative audio energy signal levels for each sub-band or frequency bin to the entropy estimator 405.

In some embodiments the entropy estimator 403 is arranged to determine a zero order entropy estimate for the received relative audio energy signal levels. The entropy estimator can then use the entropy value of the received relative audio energy levels to determine the configuration or type of multi-channel audio signal conveyed as the input signal 110.

In some embodiments the entropy value determined from the relative audio energy signal levels (ILDs) for a multi-channel audio signal comprising a left and right audio channel configuration can be used to determine whether the left and right audio channels are either a stereo type or a binaural type.

Once again it would be understood that a stereo audio signal may be distinguished from a binaural audio signal by the physical separation between the microphones when said signals are acquired. Furthermore this distinction may be reflected in the entropy of the values of the relative audio energy signal levels (ILDs) for the respective audio signals.

In some embodiments the entropy of the relative audio energy signal levels (ILDs) for the left and right channel audio signals may be given generally as $$H(X_{ILD}) = -\sum_{i=1}^{n} P(x_{ILD_i})\log P(x_{ILD_i})$$

where X represents the alphabet of possible ILD values, $H(X_{ILD})$ represents the entropy of the ILD values, $P(x_{ILD_1})$ is the probability of a particular ILD value and n is the number of possible outcomes for the set of ILD values.

The entropy $H(X_{ILD})$ can be determined for a finite number of possible values n for the range of ILD values. This may be achieved in some embodiments by scalar quantizing the ILD values to one of n possible quantization levels before the entropy value($X_{ILD}$) is determined. H.

The operation of scalar quantizing the relative audio energy signal level or interaural level (energy) difference (ILD) is shown in FIG. 6 by step 605.

In some embodiments the entropy value $H(X_{ILD})$ can be determined using a histogram based method using the following code

```
void
entropy_estim_hist(short * scales, short no_scales, float * H0, short
max_value)
{
        float h0, hist0[2*(2*MAX_ST_SCALE+1)], sum;
        short i;
        set_f(hist0, 0.0f, 2*max_value+1);
        for(i=0;i<no_scales;i++)
        {
                hist0[scales[i]]+= 1.0f;
        }
        sum = 0.0;
        for(i=0;i<=2*max_value;i++)
        {
                hist0[i] += 0.01f;
                sum += hist0[i];
        }
        sum = 1.0f/sum;
        h0 = 0.0f;
        for(i=0;i<=2*max_value;i++)
        {
                hist0[i]*=sum;
                h0 -= hist0[i]*logf(hist0[i]);
        }
        *H0 = h0/logf(2.0f);
}
```

Where 2*max_value+1 is the number of possible quantization levels for the ILD values which can correspond to n in the above expression, and scales is an array containing the quantized ILD values over which the entropy value $H(X_{ILD})$ is to be determined. The entropy estimator 405 in such embodiments effectively determines the probability of a particular quantized ILD value $P(x_{ILD_1})$ by determining the frequency of occurrence of the particular quantized ILD in the data set of quantized ILD values over which the entropy value is to be calculated. In effect the entropy estimator 405 determines the probability of each quantized ILD value by determining its histogram over a set of finite quantized ILD values. The entropy value($X_{ILD}$) corresponds to the parameter h0 in the above code. H. Furthermore the above code returns the entropy value in the unit of bits.

In summary determination of the entropy in embodiments may comprise determining the probability of the relative audio signal level by determining a histogram of a plurality of relative audio signal levels from an audio frame of the multi-channel audio signal.

In other embodiments the entropy value may be determined by using a coincidence detection approach in which entropy estimation is performed by detecting a coincidence of particular quantized ILD values, which also may be known as symbols for the purpose of determining an entropy value.

In this approach an estimate of the average number of quantized ILD values between coincidences of quantized ILD values (or symbols) is first determined. This may be performed by observing a stream of quantized ILD values and noting the number of quantized ILD values between a particular coincidence of the same quantized ILD values.

For example, if the beginning of a stream of symbols comprises the values [a g b z d g h b a z a]. Then the first coincidence of symbols occurs for the symbol g, and the number of symbols between the coincidence $D_1$ is given as 6. The second coincidence of symbols occurs for the symbol a and in this case the number of symbols between the coincidence $D_2$ is given as 5. This may be repeated for further symbols in the stream.

The estimate of the average number of quantized ILD values (or symbols) for a coincidence of symbols $\hat{D}$ may then be given as $$\hat{D} = \frac{1}{M}\sum_{m=1}^{M} D_m$$

If we assume that K represents equiprobable symbols of a memoryless random source then the entropy in bits is given as $\log_2(K)$ If we then let $\hat{K}$ be an approximation to the number of equiprobable symbols (or ILD values), $\hat{K}$ can be expressed as a function of $\hat{D}$ according to the relationship $$\hat{K}(\hat{D})=a\hat{D}^2+b\hat{D}+c, \text{ where}$$

a, b and c are given as 0.6366, −0.8493 and 0.1272 respectively.

In other words the entropy of the relative audio energy signal levels (ILDs) may be estimated by firstly determining 15 by sequentially observing quantized ILD values for coincidences as illustrated with the example above, and secondly computing $\hat{K}(\hat{D})$ according to the above expression. Finally the entropy can be estimated as $\hat{H}=\log(\hat{K})$.

It is to be appreciated that the values used in the above example only serve to illustrate the basic principle of the coincidence method for determining the entropy of a dataset, and are not a reflection of the true quantized ILD values over which said method can be applied.

In summary, other embodiments may determine the entropy by initially estimating the average number of relative audio signal level values between a coincidence of two of the same relative audio signal level values with the same value by sequentially observing a sequence of relative audio signal level values from an audio frame of the multi-channel audio signal. The entropy may then be given as a quadratic polynomial in terms of the estimated average number of relative audio signal level values.

Further details of the coincidence method for determining the entropy of a data set may be found in the reference "Simple entropy estimator for small datasets" by J. Monyalvao, D. G. Solva and R. Attux, Electronics Letters Vol. 48 No. 17, which is incorporated herein in its entirety by reference.

In some embodiments the entropy $H(X_{ILD})$ may be determined according to the $\log_2$ in order that the value of entropy is given in bits.

The operation of determining a value of entropy for the quantized relative audio energy signal level or interaural level (energy) difference (ILD) is shown in FIG. 6 by step 607.

It is to be appreciated in embodiments that the value of entropy can be determined for quantized ILD values corresponding to each frame of the input audio signal.

In embodiments the channel configuration value may then be determined by comparing the value of entropy value against a predetermined entropy decision threshold.

In particular in some embodiments, the value of entropy may be used to distinguish between a stereo audio signal and a binaural audio signal when the input audio signal comprises at least a bi-channel audio signal.

In one particular example embodiment a predetermined entropy decision threshold value of 2.5 bits was found to yield sufficient distinction between a binaural audio signal and a stereo audio signal. In other words, if the entropy for a bi-channel input audio signal is determined to be equal to or less than the predetermined entropy decision threshold, the input audio signal may be classified as a binaural audio signal. If however the entropy for the bi-channel input audio signal is determined as being greater than the predetermined entropy decision threshold then the input audio signal may be classified as a stereo audio signal.

The operation of generating the multi-channel input audio signal classification value by comparing the value of entropy against a predetermined threshold value is shown in FIG. 6 by step 609.

The overall operation by the encoder 104 of classifying the input multi-channel audio signal is shown in FIG. 5 by step 501.

The output from the entropy estimator 405 can be an audio signal classification value indicating the channel configuration of the multi-channel input audio signal 110. In particular for some embodiments when the input audio signal comprises an arrangement of audio channels comprising at least bi-channel input audio signal the output audio signal classification value may indicate whether said bi-channel input audio signal is of a binaural type or stereo type.

The audio signal classification value from the entropy estimator 405 may form one of the outputs from the audio signal classifier 301. In addition the audio signal classifier 301 may also output the relative audio energy signals levels (or ILDs) from the relative audio energy signal level determiner 403 and the frequency domain representations of the input audio signal from the frame sectioner/transformer 401 in order that they may be used by subsequent audio encoding operations.

With reference to FIG. 3 the outputs from the classifier 301 can be arranged to be passed to a channel analyser/mono encoder 303.

In some embodiments the encoder 104 can comprise a channel analyser/mono encoder 303. The channel analyser/mono encoder 303 can be configured to receive the audio signal classification value together with the frequency domain representations of the input multi-channel audio signal and the corresponding relative audio energy signal levels.

It is to be appreciated that for other embodiments the channel analyser/mono encoder 303 may just receive the audio signal classification value from the audio signal classifier 301. These particular embodiments may generate the frequency domain representations of the input multi-channel audio signal within the channel analyser/mono encoder 303.

The channel analyser/mono encoder 303 can be configured to analyse the frequency domain representations of the multi-channel input audio signal and determine parameters associated with each sub-band with respect to bi-channel or multi-channel audio signal differences.

In embodiments the analysis and parameterization of the frequency domain representations may be dependent on the audio signal classification value as determined by the classifier 301. In particular in some embodiments the form of the analysis and parameterization of the frequency domain representations can be dependent on whether the audio signal classification value indicates that the input audio signal is either of a binaural or stereo signal type. The result of the analysis may be parameters which represent the bi-channel (or more generally multi-channel) characteristics for each sub band of the input audio signal.

The channel analyser/mono encoder 303 can use the parameters associated with each sub band to down mix the multi-channel audio signal and generate a mono channel which can be encoded according to any suitable encoding scheme.

In some embodiments the generated mono channel audio signal (or reduced number of channels encoded signal) can be encoded using any suitable encoding format. For example in some embodiments the mono channel audio signal can be encoded using an Enhanced Voice service (EVS) mono channel encoded form, which may contain a bit stream interoperable version of the Adaptive Multi-Rate-Wide Band (AMR-WB) codec.

The operation of generating and encoding the mono channel (or reduced number of channels is shown in FIG. 5 by step 503.

The encoded mono channel signal can then be output. In some embodiments the encoded mono channel signal is output to a multiplexer to be combined with the output of the multi-channel parameter encoder 305 to form a single stream or output. In some embodiments the encoded mono channel signal is output separately from the multi-channel parameter encoder 305.

In some embodiments the encoder 104 comprises a multi-channel parameter encoder. In some embodiments the multi-channel parameter encoder is a bi-channel parameter encoder 305 or comprises suitable means for encoding the multi-channel parameters. The multi-channel parameter encoder 305 can be configured to receive the multi-channel parameters such as the stereo or binaural (difference) parameters determined by the channel analyser/mono encoder 303. The multi-channel parameter encoder 305 can then in some embodiments be configured to perform a quantization on the parameters and furthermore encode the parameters so that they can be output (either to be stored on the apparatus or passed to a further apparatus).

In some embodiments the multi-channel parameter encoder 305 may also receive as a further input the audio signal classification value, thereby enabling the quantization and encoding of the multi-channel parameters to be dependent on the value of said audio signal classification value.

The operation of quantizing and encoding the quantized multi-channel parameters is shown in FIG. 5 by step 505.

In other embodiments the of the encoder 104 the channel analyser and multi-channel parameter encoding stages may be performed in one coding entity before the mono channel signal is formed.

In such embodiments the encoder 104 can initially analyse the frequency domain representations of the multi-channel input audio signal and determine parameters associated with each sub-band with respect to bi-channel or multi-channel audio signal differences, and then perform quantization and encoding on the multi-channel parameters. In these embodiments the mono audio signal may then be subsequently formed by using the parameters associated with each sub band to down mix the multi-channel audio signal. The resulting mono channel can then be encoded according to any suitable encoding scheme as mentioned above.

Thus in at least one of the embodiments there can be an apparatus comprising: means for estimating a value of entropy for a multi-channel audio signal; means for determining a channel configuration of the multi-channel audio signal from the value of entropy; and means for encoding the multi-channel audio signal, wherein the mode of encoding is dependent on the channel configuration.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

estimating a value of entropy for a multi-channel audio signal;

determining a channel configuration of the multi-channel audio signal from the value of entropy, wherein determining the channel configuration comprises determining at least one of a binaural audio signal channel arrangement or a stereo audio signal channel arrangement by comparing the value of entropy against a threshold value, classifying the channel configuration as a first audio signal channel arrangement when the value of entropy is below or equal to the threshold value, and classifying the channel configuration as a second audio signal channel arrangement when the value of entropy is above the threshold value; and encoding, with an audio codec, the multi-channel audio signal, wherein a mode of encoding is dependent on the channel configuration.

2. The method as claimed in claim 1, wherein the multi-channel audio signal comprises at least a first audio channel signal and a second audio channel signal, and wherein estimating the value of entropy for the multi-channel audio signal comprises:

transforming the first audio channel signal and the second audio channel signal each into a frequency domain audio signal comprising a plurality of frequency bands;

determining a relative audio signal level by determining an audio signal level in a frequency band of the first audio channel signal relative to an audio signal level in a frequency band of the second audio channel; and determining the value of entropy from the relative audio signal level.

3. The method as claimed in claim 2, wherein determining the value of entropy from the relative audio signal level comprises:

determining the probability of the relative audio signal level by determining a histogram of a plurality of relative audio signal levels from an audio frame of the multi-channel audio signal.

4. The method as claimed in claim 2, wherein determining the value of entropy from the relative audio signal level comprises:

estimating the average number of relative audio signal level values between a coincidence of two relative audio signal level values with the same value by sequentially observing a sequence of relative audio signal level values from an audio frame of the multi-channel audio signal.

5. The method as claimed in claim 2, wherein the audio signal level comprises the magnitude of the audio signal in the frequency band.

6. The method as claimed in claim 2, wherein the relative audio signal level is an interaural level difference.

7. The method as claimed in claim 1, wherein the first audio signal channel arrangement is a binaural audio signal channel arrangement, and the second audio signal channel arrangement is a stereo audio signal channel arrangement.

8. An apparatus of an audio codec comprising at least one processor and at least one memory including computer code, the at least one memory and the computer code configured to with the at least one processor cause the apparatus to:

estimate a value of entropy for a multi-channel audio signal;

determine a channel configuration of the multi-channel audio signal from the value of entropy, wherein determine the channel configuration comprises determine at least one of a binaural audio signal channel arrangement or a stereo audio signal channel arrangement by comparing the value of entropy against a threshold value, classifying the channel configuration as a first audio signal channel arrangement when the value of entropy is below or equal to the threshold value, and classifying the channel configuration as a second audio signal channel arrangement when the value of entropy is above the threshold value; and encode the multi-channel audio signal, wherein a mode of encoding is dependent on the channel configuration.

9. The apparatus as claimed in claim 8, wherein the multi-channel audio signal comprises at least a first audio channel signal and a second audio channel signal, and wherein the apparatus caused to estimate the value of entropy for the multi-channel audio signal is further caused to:

transform the first audio channel signal and the second audio channel signal each into a frequency domain audio signal comprising a plurality of frequency bands;

determine a relative audio signal level by the apparatus being caused to determine an audio signal level in a frequency band of the first audio channel signal relative to an audio signal level in a frequency band of the second audio channel signal; and determine the value of entropy from the relative audio signal level.

10. The apparatus as claimed in claim 9, wherein the apparatus caused to determine the value of entropy from the relative audio signal level is further caused to:

determine a probability of the relative audio signal level by being caused to determine a histogram of a plurality of relative audio signal levels from an audio frame of the multi-channel audio signal.

11. The apparatus as claimed in claim 9, wherein the apparatus caused to determine the value of entropy from the relative audio signal level is further caused to:

estimate an average number of relative audio signal level values between a coincidence of two relative audio signal level values with the same value by sequentially observing a sequence of relative audio signal level values from an audio frame of the multi-channel audio signal.

12. The apparatus as claimed in claim 9, wherein the audio signal level comprises a magnitude of the audio signal in the frequency band.

13. The apparatus as claimed in claim 9, wherein the relative audio signal level is an interaural level difference.

14. The apparatus as claimed in claim 8, wherein the first audio signal channel arrangement is a binaural audio channel arrangement, and the second audio signal channel arrangement is a stereo audio channel arrangement.

15. A computer program product comprising at least one non-transitory computer readable storage medium, the computer readable storage medium comprising a set of instructions which, when executed by one or more processors of an audio codec, causes an apparatus to:

estimate a value of entropy for a multi-channel audio signal;

determine a channel configuration by determining at least one of a binaural audio signal channel arrangement or a stereo audio signal channel arrangement by comparing the value of entropy against a threshold value; classify the channel configuration as a first audio signal channel arrangement when the value of entropy is below or equal to the threshold value, and classifying the channel configuration as a second audio signal channel arrangement when the value of entropy is above the threshold value; and encode the multi-channel audio signal, wherein a mode of encoding is dependent on the channel configuration.

16. The computer program product as claimed in claim 15, wherein the multi-channel audio signal comprises at least a first audio channel signal and a second audio channel signal, and wherein the computer program product which causes the apparatus to estimate the value of entropy for the multi-channel audio signal further causes the apparatus to:

transform the first audio channel signal and the second audio channel signal each into a frequency domain audio signal comprising a plurality of frequency bands;

determine a relative audio signal level by the apparatus being caused to determine an audio signal level in a frequency band of the first audio channel signal relative to an audio signal level in a frequency band of the second audio channel signal; and determine the value of entropy from the relative audio signal level.

17. The computer program product as claimed in claim 16, wherein the computer program product which causes the apparatus to determine the value of entropy from the relative audio signal level further causes the apparatus to:

determine a probability of the relative audio signal level by being caused to determine a histogram of a plurality of relative audio signal levels from an audio frame of the multi-channel audio signal.

* * * * *